US010105711B2

(12) United States Patent
Huang et al.

(10) Patent No.: US 10,105,711 B2
(45) Date of Patent: Oct. 23, 2018

(54) HIGH-EFFICIENCY, SERIAL BIAXIAL DYNAMIC CLASSIFICATION AND RECOVERED DUST MILLING APPARATUS WITH AUTOMATIC BAFFLEPLATE REGULATION

(71) Applicant: Xi'an Forest Electric Power Science & Technology Co., Ltd., Xi'an, Shaanxi (CN)

(72) Inventors: Lina Huang, Hubei (CN); Dezhong Li, Hubei (CN); Lixin Huang, Hubei (CN)

( * ) Notice: Subject to any disclaimer, the term of this patent is extended or adjusted under 35 U.S.C. 154(b) by 712 days.

(21) Appl. No.: 14/648,683

(22) PCT Filed: Nov. 29, 2013

(86) PCT No.: PCT/CN2013/088137

§ 371 (c)(1),
(2) Date: May 29, 2015

(87) PCT Pub. No.: WO2014/082596

PCT Pub. Date: Jun. 5, 2014

(65) Prior Publication Data

US 2015/0314330 A1 Nov. 5, 2015

(30) Foreign Application Priority Data

Nov. 30, 2012 (CN) ..... 2012 1 0507389

(51) Int. Cl.
*B07B 7/08* (2006.01)
*B02C 19/00* (2006.01)
(Continued)

(52) U.S. Cl.
CPC ..... *B02C 19/005* (2013.01); *B02C 23/14* (2013.01); *B07B 7/083* (2013.01); *B02C 2015/002* (2013.01)

(58) Field of Classification Search
CPC ..... B07B 7/08; B07B 7/083; B07B 7/086; B07B 7/10; B07B 11/02; B07B 11/04;
(Continued)

(56) References Cited

U.S. PATENT DOCUMENTS 3,040,888 A * 6/1962 Hosokawa ..... B07B 7/08 209/714
4,265,740 A * 5/1981 Luthi ..... B04C 5/103 209/159

(Continued)

*Primary Examiner* — Joseph C Rodriguez
(74) *Attorney, Agent, or Firm* — Wayne & King LLC

(57) ABSTRACT

A high-efficiency, tandem biaxial dynamic sorting and return powder milling device with automatic baffle regulation, which is used for the sorting of a gas-solid two-phase fluid of an air-powder mixture, is provided. A circle of milling gears for staged milling of return powders is mounted in an annular cavity between an outer conical housing and an inlet pipe; an axial flow airfoil-type vane is fitted on an outer side of a lower part of an inner conical body which is, as a whole, driven into rotation by a variable frequency motor; a movable vane rotor for centrifugal sorting is fixedly fitted on an outer side of a top cone; and the degrees of opening of first-stage baffles and second-stage baffles are respectively controlled and regulated by an automatic baffle regulating mechanism.

10 Claims, 4 Drawing Sheets

(51) Int. Cl.

| | |
|---|---|
| ***B02C 23/14*** | (2006.01) |
| ***B07B 7/083*** | (2006.01) |
| *B02C 15/00* | (2006.01) |

(58) Field of Classification Search
CPC ..... B07B 11/06; B02C 23/10; B02C 23/14; B02C 23/30; B02C 15/001; B02C 15/003; B02C 15/006; B02C 2015/002
See application file for complete search history.

(56) References Cited

U.S. PATENT DOCUMENTS 4,296,864 A * 10/1981 Misaka ..... B07B 4/025 209/135
5,120,431 A * 6/1992 Cordonnier ..... B07B 7/083 209/135
5,511,668 A * 4/1996 Keuschnigg ..... B07B 7/083 209/135
6,290,071 B1 * 9/2001 Fisher ..... B07B 7/083 209/713
6,318,559 B2 * 11/2001 Cordonnier ..... B07B 7/083 209/154
6,827,221 B1 * 12/2004 Brundiek ..... B02C 23/16 209/208
8,033,399 B2 * 10/2011 Pistorius ..... B07B 7/083 209/142
8,100,269 B2 * 1/2012 Taketomi ..... B07B 4/02 209/138
8,813,967 B2 * 8/2014 Plant ..... B07B 7/02 209/139.1
2011/0281713 A1 * 11/2011 Devroe ..... B07B 4/04 494/26
2015/0060582 A1 * 3/2015 Truce ..... B02C 23/12 241/38

* cited by examiner

HIGH-EFFICIENCY, SERIAL BIAXIAL DYNAMIC CLASSIFICATION AND RECOVERED DUST MILLING APPARATUS WITH AUTOMATIC BAFFLEPLATE REGULATION

CROSS-REFERENCE TO RELATED APPLICATIONS

The present application is a U.S. National Stage entry under 35 U.S.C. § 371 of International Application No. PCT/CN2013/088137, filed on Nov. 29, 2013, which in turn claims priority to Chinese Patent Application No. 201210507389.X, filed on Nov. 30, 2012, the entire texts whereof are incorporated by reference into the present application.

TECHNICAL FIELD

The present invention relates to a coal powder gas-solid two-phase fluid sorting and milling device, and particularly to a high-efficiency, tandem biaxial dynamic sorting and return powder milling device with automatic baffle regulation.

BACKGROUND ART

In recent years, due to changes in market prices of coal, the quality of coal for thermal power plant boiler burning is not only significantly poorer than the designed coal quality, but also the coal quality changes frequently, resulting in the varying of boiler coal consumption at the same load, thereby causing the seriously insufficient output of a pulverizing system, so that the fineness of coal powders is coarse, seriously affecting the operation safety and economy of the power station pulverized coal boiler. In order to increase the output of the pulverizing system and reduce the unit consumption of pulverization of a steel-ball coal mill, a variety of coal powders sorting techniques are introduced. In the variety of coal powders sorting techniques, a tandem biaxial coarse powder separator is vigorously promoted in practical applications due to its low resistance and high separation efficiency. However, it also has the problems of serious wear and being easy to deposit powders on the baffles, etc. With the constantly improving of dynamic separation techniques, the dynamic separator is widely used in medium speed coal mills because it has the advantages of large coal fineness adjustable range and high coal powder uniformity index etc., and at the same time, the dynamic separation techniques also begin to be used in an intermediate storage pulverizing system of the steel-ball coal mill. However, when the quality of the milled coal becomes worse, the dynamic separator also has problems of the fineness of the coal powders being finer, increasing the circulation rate, reducing the separation efficiency, and increasing the resistance, thereby limiting the development of dynamic separation techniques.

CONTENTS OF THE INVENTION

The technical problem to be solved by the present invention is to provide a high-efficiency, tandem biaxial dynamic sorting and return powder milling device with automatic baffle regulation in order to solve the above-mentioned problem. In order to adapt the changes in the power station boiler load and burning coal quality, improve the output of the pulverizing system, and make the coal powder fineness adjustment convenient, the present invention proposes a novel coal powder sorting technique combined with the dynamic sorting technique on the basis of a tandem biaxial dynamic sorting technique. This sorting technique adopts a multi-stage sorting technique such as centrifugal sorting, gravity sorting to sort and mill the coal powders and return powders stage-by-stage, so as to decrease the rate of qualified coal powders to return powders and circulation rate, and improve the sorting efficiency; at the same time, the deflector technology, axial ventilation technology and the outlet pipe spiral rotation design are used to reduce the resistance of the sorting device, thereby achieving the purposes of improving the output of the pulverizing system and reducing the unit consumption of pulverization.

Said high-efficiency, tandem biaxial dynamic sorting and return powder milling device with automatic baffle regulation, comprises a sorting device inlet pipe, an inner conical body, and an outer conical housing provided with a return powder outlet pipe at the bottom, a plurality of first-stage baffles being horizontally provided along an inner circumference of said outer conical housing at the middle height of the inner conical body, a circle of second-stage baffles being horizontally provided along the interior of the outer conical housing on said first-stage baffles, said first-stage baffles and second-stage baffles being both fixed at a single end to a baffle shaft, and an regulating rod being provided on an outer portion of the baffle shaft passing out of the outer conical housing; an upper portion of the outer conical housing being provided with a plurality of explosion-proof doors, a variable frequency motor being provided outside a top plate of the outer conical housing, and said top plate having an opening and being connected to an outlet main pipe, characterized in that an inner bearing bush fixing pipe is fixedly mounted outside said sorting device inlet pipe, a circle of milling gears for milling return powders is mounted in an annular cavity between the outer conical housing and the inner bearing bush fixing pipe, said milling gears are of a conical structure tapering from outside to inside, gear shafts at the inner end and outer end of the milling gears are respectively fitted onto the inner bearing bush fixing pipe and the outer conical housing via milling apparatus bearings, every two adjacent milling gears are meshed with each other, and the gear shaft of one of the milling gears extends out of the outer conical housing and is driven by a milling variable frequency motor.

The milling apparatus bearings at the two ends of said milling gears are both provided with a sealing device for preventing leaked coal powders from entering the bearings.

An axial flow airfoil-type vane is fitted on an outer side of an impact cone of said inner conical body.

A movable vane rotor composed of a movable vane is fixedly mounted on an outer side of the top cone of said inner conical body, so as to centrifugally sort the coal powders.

The degrees of opening of said first-stage baffles and second-stage baffles are respectively controlled and regulated by a respective automatic baffle regulating mechanism which comprises a motor with a brake and guiding pulleys, each baffle shaft is fixed to a dial perpendicular thereto at the exterior of the outer conical housing, and a steel wire rope fixing device is provided between an outer edge of said dial and the regulating rod fixed to the same baffle shaft, and the shaft sleeve is welded to the outer conical housing and is reinforced via a rib; said baffle shaft is fixed inside a shaft sleeve of the bearing; and an output shaft of said motor with a brake is fixed to a steel wire rope, said steel wire rope is successively wound around the guiding pulley at one side of the dial, to the steel wire rope fixing device along the outer edge of the dial, continuing to the guiding pulleys between adjacent dials along the outer edges of the dials, is connected in series with the circle of the first-stage baffles or the second-stage baffles, respectively, and finally returns to the output shaft of the motor with a brake fixed to the steel wire rope, forming a closed steel wire rope regulating ring.

The motor with a brake of said first-stage baffles or second-stage baffles is mounted above the first-stage baffles or the second-stage baffles, the steel wire rope driven by said motor with a brake is horizontally oriented at two sides of said motor output shaft, changed to be oriented vertically after passing the pulley, and is wound around the guiding pulleys on side faces of two adjacent dials, and connected to each dial and regulating rod in sequence.

A balancing weight for regulating the degree of balance of the automatic regulating mechanism is fixed to each of the steel wire ropes in vertical orientation of said steel wire rope at the two sides of the motor with a brake.

A plurality of openings connected to the outlet pipe are evenly distributed in said top plate, and the other end of said outlet pipe is connected to an input end of the outlet main pipe.

As an optimized solution, four outlet pipes are provided above said top plate, and the four outlet pipes spirally rotate and are connected to the outlet main pipe.

A movable vane rotor for centrifugal sorting is fixedly mounted on an outer side of an upper portion of said inner conical body; and a clearance is remained between said inner conical body and both said first-stage baffles and second-stage baffles, and the inner conical body is a cavity driven to rotate by an output shaft of the variable frequency motor.

The present invention consists of three parts, namely a dynamic sorting device, a static sorting device and a return powder milling device, wherein the dynamic sorting device consists of a variable frequency motor, an inner conical body, and an axial flow airfoil-type vane at the lower end of the inner conical body and a movable vane rotor at the upper end thereof; the static sorting device consists of an outer conical body, two stage baffles fixed at the outer conical body, and an automatic baffle regulating device; and the return powder milling device consists of a variable frequency motor, a coupling with a gearbox, milling device bearings, bearing sleeves and a wear-resistant gear set. In a normal operation, the inner conical body rotation variable frequency motor dives the whole inner cone to rotate, so as to change the rotation of the motor by means of regulating the frequency of a frequency changer, regulating the rotation speed of the inner conical body, thereby regulating the fineness of the coal powders, and the baffles are opened fully or at a certain angle for guiding the air-powder mixture; and the unqualified coal powders fall along an inner wall of a shell of the sorting device to the wear-resistant gear set which is provided at the lower portion of a return powder collecting pipe, part of the unqualified coal powders in the return powders will be milled into qualified coal powders by means of the milling variable frequency motor driving the wear-resistant gears to rotate. If the dynamic sorting fails, the variable frequency motor can be immediately stopped, then starting the baffle automatic regulating mechanism and changing the dynamic sorting into the static sorting, the return powder milling device for its part is formed integrally and can operate independently without being affected by the fault, of the dynamic part, so that the influence of the fault of the pulverizing system equipment on the operation of the boiler will be reduced to a minimum, thereby improving the operational reliability of the milling system equipment.

Compared with the existing static and dynamic sorting devices, the present invention has the following distinguishing features:

1. The inner conical body is an enclosed cavity, an upper portion thereof is provided with a rotor composed of a movable vane for performing the final sorting on the coal powder fineness, a lower portion thereof is provided with a rotary axial flow airfoil-type vane functioning to pre-sort the air-powder mixture primarily entering the sorting device, such that part of the coarse coal powders are sorted out under the centrifugal action, meanwhile, the rotary axial flow airfoil-type vane also increases the opportunity of performing secondary sorting on the coal powders sorted out from the upper end, such that part of the sorted qualified coal powders are subjected to the secondary sorting, thereby reducing the circulation rate and improving the sorting efficiency. Furthermore, the axial flow airfoil-type vane further has the function of generating a lifting pressure head to reduce the resistance of the sorting device.

2. The two stage baffles of the outer conical housing are both fixed at a single end, the baffle shaft is fixed to the shaft sleeve via bearings such that the baffles rotate flexibly and jamming will not occur, and the sealing technique is used to ensure the stable operation of the bearings. The fixing rib of the shaft sleeve can ensure the stable operation of the baffles without deformation.

3. The baffle automatic regulating mechanism uses a steel wire rope to pull a baffle regulation connecting rod, and the orientation of the steel wire rope is changed via the guiding pulleys to automatically regulate the baffles, thereby automatically regulating the fineness of the coal powders.

Four pipes are provided at the outlet of the sorting device, and finally after rotating in the airflow rotation direction by a certain angle, the four pipes are welded to the outlet pipe, so as to converge into an outlet pipe, reducing the rotation strength and resistance of the qualified coal powders.

4. The baffles and the axial flow airfoil-type vane are cast, all the parts to be badly worn adopt a wear preventive treatment to reduce wear and improve the service life of the device.

5. The advantages of the tandem biaxial static sorting device and of the dynamic sorting device are concentrated in the present invention, not only can operate in the dynamic mode, in the static mode, but also in the combined dynamic and static mode, improving the operation efficiency and reliability.

6. The return powder milling part adopts a wear-resistant gear set, milling part of the unqualified coal powders in the return powders into qualified coal powders by means of the mutual rolling and milling of the wear-resistant gears, greatly reducing the circulation rate and improving the coal powder uniformity index, thereby greatly improving the sorting efficiency and the output of the pulverizing system.

7. The tandem biaxial two-stage baffle can automatically regulate the angle, so as to achieve the automatic regulation of the fineness of the coal powders in case that the dynamic sorting device cannot run. The requirements of the output of the pulverizing system and the output and the fineness of the coal powders are satisfied for the changes in the power station boiler load and changes in coal quality, improving the boiler efficiency and reducing nitrogen oxide emissions.

The present invention has the beneficial effects of adopting a multi-stage sorting of an air-powder gas-solid two-phase fluid and staged milling of return powders, so as to improve the sorting efficiency of the sorting device to a great extent, thereby improving the output of a pulverizing system, and reducing unit consumption of pulverization, while also expanding the range for regulating the fineness of coal powders and greatly increasing the coal powder uniformity index, thereby improving the adaptive capability of power station boiler combustion to the coal quality. The present invention can also be applied to material sorting devices in industries such as cement, metallurgy or petrifaction.

In the figures: 1—sorting device inlet pipe, 2—expanded cone, 3—axial flow airfoil-type vane, 4—impact cone, 5—inner conical body, 6—first-stage baffles, 7—second-stage baffles, 8—top cone, 9—output shaft, 10—movable vane rotor, 11—inner conical body rotation variable frequency motor, 12—outlet pipe, 13—explosion-proof door, 14—outlet main pipe, 15—oblique return powder outlet pipe, 16—rib, 17—bearing, 18—shaft sleeve, 19—baffle shaft, 20—fixing frame, 21—regulating rod, 22—steel wire rope fixing device, 23—motor with a brake, 24—steel wire rope, 25—balancing weight, 26—guiding pulley, 27—outer conical housing, 28—inner bearing bush fixing pipe, 29—outer bearing bush fixing pipe, 30—milling device bearing, 31—milling variable frequency motor, 32—coupling with a gearbox, 33—outer-end bearing bush, 34—milling gear, 35—gear shaft, 36—inner-end bearing bush, 37—dial, and 38—top plate.

PARTICULAR EMBODIMENTS

Figure 1:
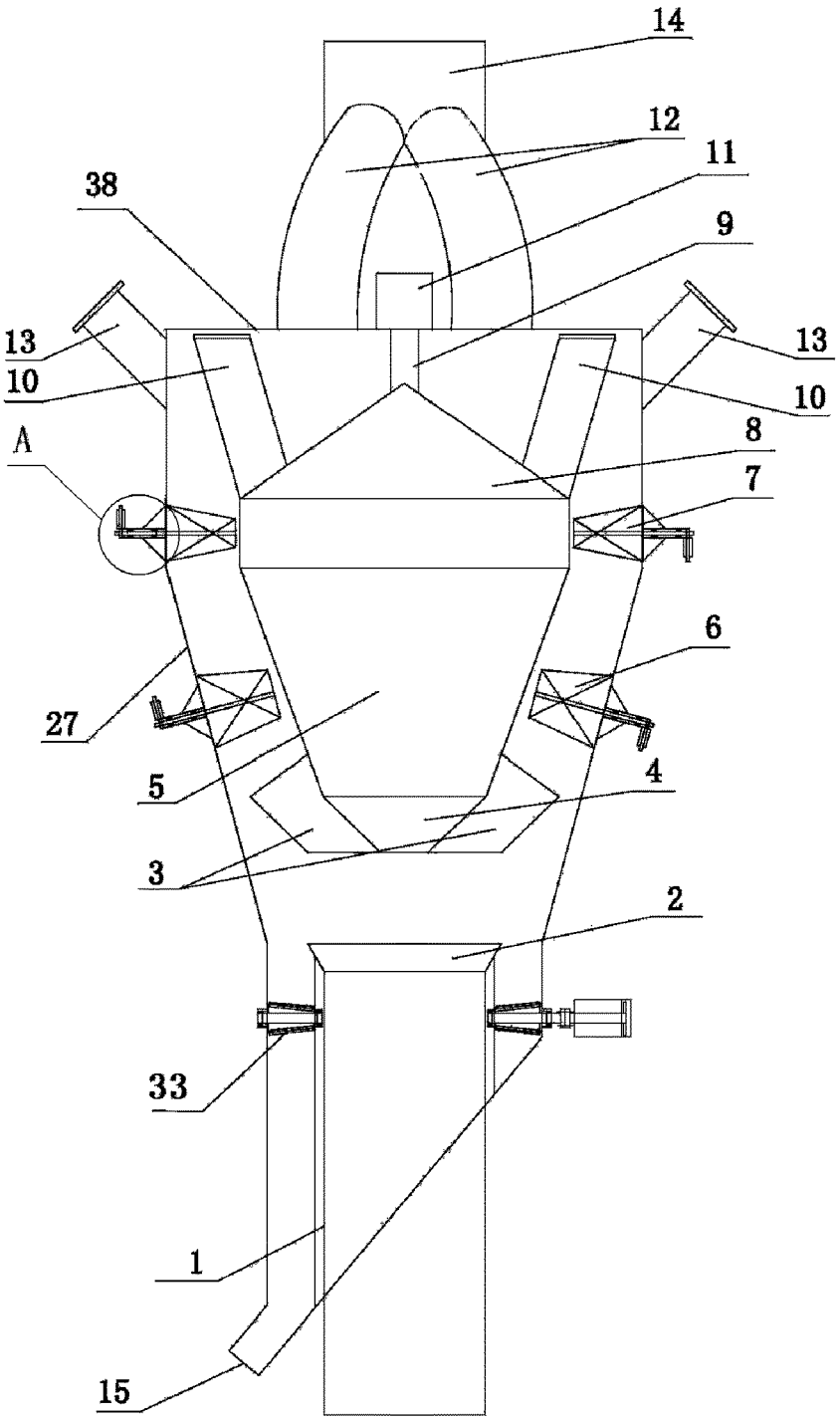
FIG. 1 is a frontal sectional view of a longitudinal section of the overall structure of the present invention.
Figure 2:
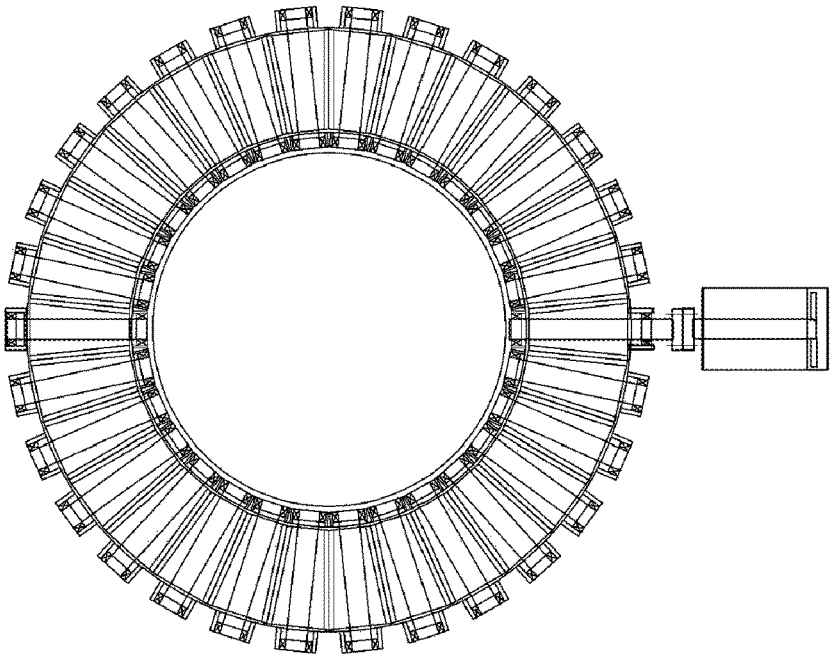
FIG. 2 is an enlarged top view of a return powder milling gear disk.
Figure 3:
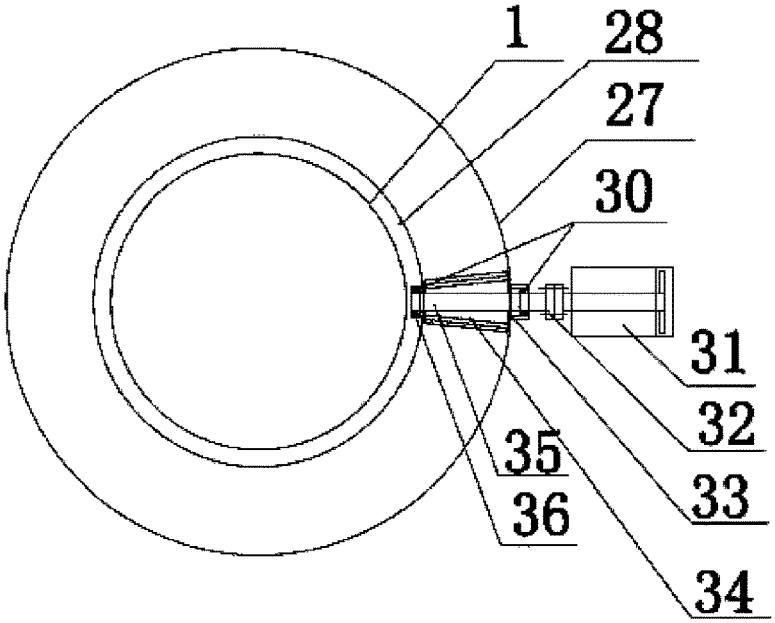
FIG. 3 is a constructional view of the connection of a single milling gear and the entirety.

The present invention will be further explained below in conjunction with the figures: as shown in FIG. 1, said high-efficiency, tandem biaxial dynamic sorting and return powder milling device with automatic baffle regulation comprises a sorting device inlet pipe 1, an enclosed inner conical body 5, an outer conical housing 27 of a return powder outlet pipe 15; and the top end of the sorting device inlet pipe 1 is generally provided with an expanded cone 2, the inner conical body 5 is provided with an impact cone 4 at the bottom and with a top cone 8 at the top, and the return powder outlet pipe 15 is coaxial with said inner conical body and is mounted at an oblique outlet at the bottom of the inner conical body. A plurality of first-stage baffles 6 are provided along an inner circumference of said outer conical housing 27, a circle of second-stage baffles 7 are provided along the interior of the outer conical housing 27 above said first-stage baffles 6, said first-stage baffles 6 and second-stage baffles 7 are both fixed at a single end to a baffle shaft 19, and an regulating rod 21 is provided on an outer portion of the baffle shaft passing out of the outer conical housing; an upper portion of the outer conical housing is provided with a plurality of explosion-proof doors 13, an inner conical body rotation variable frequency motor 11 is fitted outside a top plate 38 of the outer conical housing, an output shaft of the variable frequency motor is connected to a gearbox with a coupling, and an output shaft of the gearbox passes through the top plate and is connected to said inner conical body 5, as shown in FIGS. 2, 3, an inner bearing bush fixing pipe 28 is fixedly sheathed outside said sorting device inlet pipe 1, a circle of milling gears 34 for milling return powders step-by-step is mounted in an annular cavity between the outer conical housing 27 and the inner bearing bush fixing pipe 28, said milling gears 34 are of a conical structure, the inner and outer ends of a gear shaft 35 thereof are respectively fitted onto the inner bearing bush fixing pipe 28 and the outer conical housing via milling device bearings 30, every two adjacent milling gears are meshed with each other, and the rotary shaft of one of the milling gears 34 passes through the coupling with a gearbox 32 to be fixed to an output shaft of a milling variable frequency motor 31. Adding the milling disks for the return powders can greatly increase the fineness of the return powers at a high efficiency, making the sorting system in this device screened mills the sorted coarse return powders again to make most of the unqualified return powders to become qualified return powders.

As shown in FIG. 1, the top end of said inlet pipe 1 is provided with the expanded cone 2, said expanded cone 2 is welded to the top end of the sorting device inlet pipe 1, when the air-powder mixture passes through the expanded cone 2 with the flow-though area gradually increasing, the speed is reduced to produce gravity sorting, and part of the large particles of coal powders are sorted out because of stall. The inner conical body 5 is designed as an enclosed cavity, which is sheathed inside the outer conical housing 27 and axial with the outer conical housing 27, and an air-powder mixture flowing channel is located between the inner conical body and the outer conical housing; and the inner conical body 5 is driven to rotate by the inner conical body rotation variable frequency motor 11 placed at the top of the sorting device.

As shown in FIGS. 2, 3, the return powder milling device is mounted at the oblique return powder outlet pipe 15, and adopts wear-resistant gears to mill the return powders by means of crushing and grinding. The circle of milling gears 34 is distributed at the oblique return powder outlet pipe 15, one end of the milling gear 34 is fixed to the outer-end bearing bush 33 and inner-end bearing bush 36 via an outer ring of the milling device bearing, the outer-end bearing bush 33 and the inner-end bearing bush 36 are respectively welded to the outer conical housing 27 and the inner bearing bush fixing pipe 28, the inner bearing bush fixing pipe 28 and the sorting device inlet pipe 1 constitute an enclosed cavity, and the enclosed cavity is connected at the bottom to a clean instrument compressed air pipe through a pipeline, ensuring that the pressure in the cavity is higher than the pressure in the oblique return powder outlet pipe 15. The milling variable frequency motor 31 is connected to a certain milling gear 34 via the coupling with a gearbox 32, regulating the rotation speed of the frequency changer, so as to change the rotation speed of the milling gear 34, driving the remaining milling gears to rotate, so that part of the unqualified return powders are milled into qualified coal powders.

The milling device bearings 30 at two ends of said milling gears 34 are both mounted outside said annular cavity, such that the dust pollution on the milling device bearings 30 is reduced.

As shown in FIG. 1, an axial flow airfoil-type vane 3 is fitted on an outer side of the lower portion of said inner conical body 5.

The axial flow airfoil-type vane is provided at the inner end of the inner conical body, using the rotation of the axial flow airfoil-type vane 3 to drive the air-powder mixture to rotate, part of the coarse coal powder are thrown to the inner wall of the outer conical housing 27 under the action of centrifugal separation to generate a centrifugal sorting; meanwhile, since the rotation of the vane functions to increase the speed of the air-powder mixture, part of the sorted qualified coal powders have the opportunity to participate in the secondary sorting, reducing the circulation rate, improving the sorting efficiency, enhancing the sorting device pressure head, and reducing the resistance of the sorting device As shown in FIG. 1, a movable vane rotor 10 carrying out centrifugal sorting is fixedly mounted on an outer side of the top cone 8 of said inner conical body 5.

The upper end of the inner conical body 5 is provided with a rotatable movable vane rotor 10, which performs the final centrifugal sorting on the multi-stage sorted coal powders, the qualified coal powders enter the sorting device outlet pipe 12, and the unqualified coal powders, after being stalled, fall down along the inner wall of the outer conical housing 27 due to centrifugal sorting.

Figure 4:
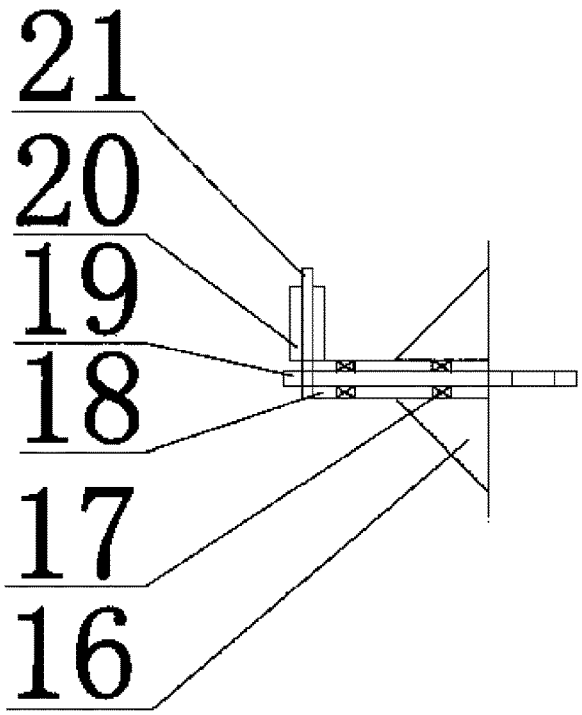
FIG. 4 is an enlarged view of A in FIG. 1.
Figure 5:
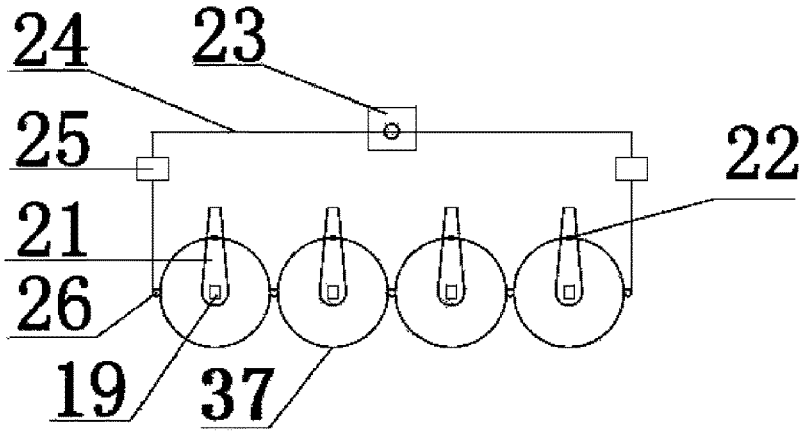
FIG. 5 is a schematic view of an automatic baffle regulating mechanism in an expanded state.
Figure 7:
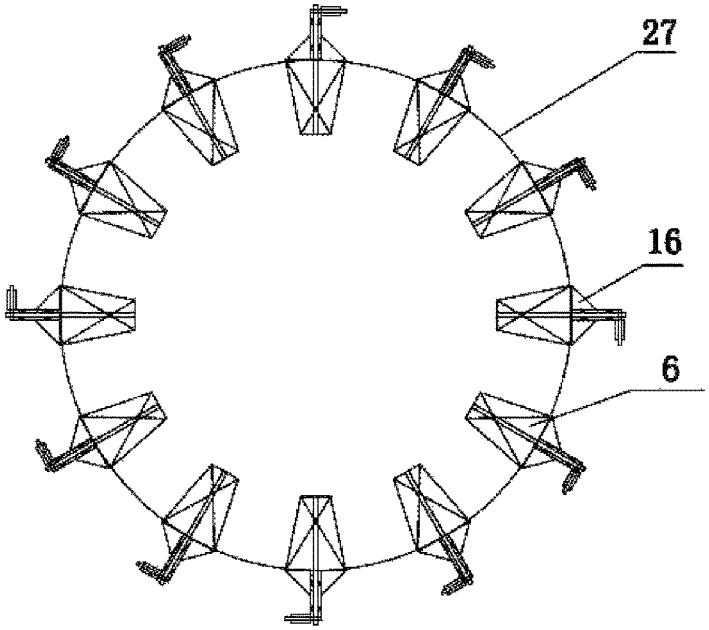
FIG. 7 is an enlarged sectional view of the transverse section of the first-stage baffle or the second-stage baffle.

As shown in FIGS. 4, 5 and 7, the deflecting direction of said first-stage baffles 6 and second-stage baffles 7 are controlled and regulated by an automatic baffle regulating mechanism which comprises a motor with a brake 23 and guiding pulleys 26, each baffle shaft 19 passes through a dial 37 at the exterior of the outer conical housing and is fixed relative to the dial, and a steel wire rope fixing device 22 is provided between an outer edge of said dial and the regulating rod fixed to the same baffle shaft 19; said baffle shaft 19 is fixed inside a shaft sleeve 18 via the bearings 17, and the shaft sleeve is welded to the outer conical housing and is reinforced via a rib 16; and an output shaft of said motor with a brake 23 is fixed to a steel wire rope 24, said steel wire rope 24 is successively wound around the guiding pulley 26 at one side of the dial 37, to the steel wire rope fixing device 22 along the outer edge of the dial 37, to the guiding pulleys 26 on the same side of adjacent dials 37 along the outer edges of the dials 37, is connected in series with the circle of the first-stage baffles 6 or the second-stage baffles 7, respectively, and finally returns to the output shaft of the motor with a brake 23 fixed to the steel wire rope 24, forming a closed steel wire rope regulating ring.

Both said first-stage baffles 6 and second-stage baffles 7 are provided with an automatic regulating mechanism, the automatic regulating mechanism of the first-stage baffles 6 and second-stage baffles 7 each comprises a motor with a brake 23, the motor with a brake 23 of the first-stage baffles 6 or second-stage baffles 7 is mounted above the first-stage baffles 6 or the second-stage baffles 7, two sides of the steel wire rope 24 driven by said motor with a brake 23 are respectively changed to be oriented vertically by means of passing the pulleys, and are wound around the guiding pulleys 26 on side faces of two adjacent dials 37, and connected to each dial 37 and regulating rod 21 in sequence.

A balancing weight 25 for regulating the degree of balance of the automatic regulating mechanism is fixed to each of the steel wire ropes in vertical orientation of said steel wire rope 24 at the two sides of the motor with a brake 23.

The foot end of the baffle regulating rod 21 is fixedly connected to the baffle shaft 19 the rotation of the baffle regulating rod 21 can drive the baffle shaft 19 to rotate, thereby achieving the purpose of regulating the degrees of opening of the first-stage and second-stage baffles 6, 7 to regulate the fineness of the coal powders. The top end of the baffle regulating rod 21 is clamped in a fixing frame snapping slot, the snapping slot plays the role of guiding, facilitating the rotation of the baffle regulating rod to the left and right; meanwhile, the upper portion of the baffle regulating rod is connected to the steel wire rope 24, and the steel wire rope 24 changes the orientation via the guiding pulleys 26 and is connected to the adjacent baffle regulating rods. And so on, the top end of the final baffle regulating rod 21 is connected to the motor with a brake 23 via the balancing weight 25, and drives the steel wire rope by means of the forward and reverse rotation of the motor to trigger the rotation of the baffle regulating rod to achieve the automatic regulation of the baffles, so as to regulate the fineness of the coal powders. This invention changes the current situation in which one needs to climb to the conical body for manually regulating one by one, greatly reducing the labour intensity of the baffle regulating personnel, which is easy for the operation personnel to optimally regulate the boiler combustion due to the changes in unit load and coal quality.

Figure 6:
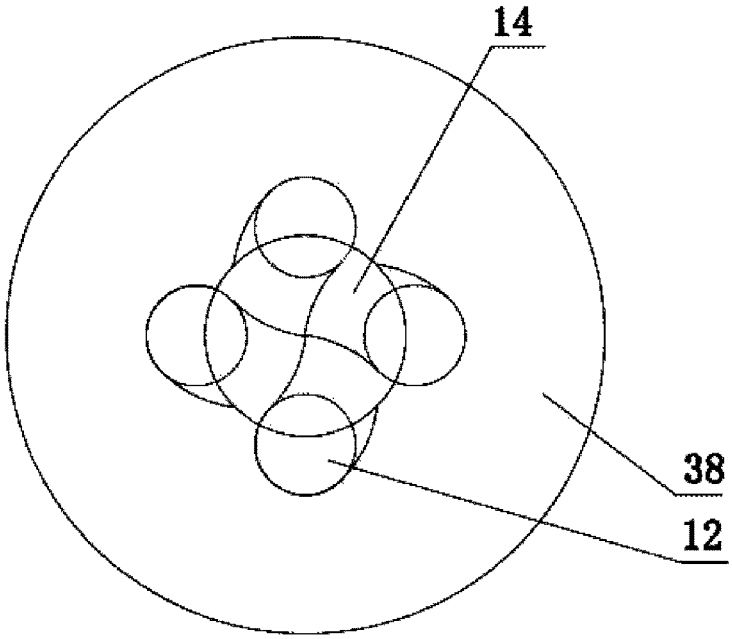
FIG. 6 is an enlarged sectional view of the transverse section at the top plate.

As shown in FIG. 6, the top plate 38 of said outer conical housing 27 is provided with an outlet pipe 12, and the other end of said outlet pipe is opened into the outlet main pipe 14.

Four outlet pipes 12 are provided above said top plate 38, all the other ends thereof are opened into the outlet main pipe 14, and the four outlet pipe 12 spirally rotate in the airflow direction and are connected to the outlet main pipe 14.

A certain inclined angle is formed between the four outlet pipes 12 provided at the outlet of the sorting device and the sorting device top plate 38, the inclined angle being consistent with the rotation direction of the coal powders, and the outlet pipes are welded to the outlet main pipe 14 after rotating around the outlet main pipe by a certain angle, so as to reduce the wear and resistance of the outlet pipes, improving the outlet of the pulverizing system.

The air-powder mixture passes through the sorting device inlet pipe 1, sue to the increasing area of the expanded cone 2, the flowing rate is reduced, part of the coal powders are sorted out due to gravity, and some coarse coal powders of the remaining coal powders are sorted out due to the collision with the impact cone 4, since the inner conical body rotation variable frequency motor 11 drives the entire inner conical body to rotate by the output shaft 9, some of the coal powders rotates following the axial flow airfoil-type vane 3, part of the coarse coal powders are sorted out, after the air-powder mixture passes through the axial flow airfoil-type vane 3 and is guided by the first-stage baffles 6 and the second-stage baffles 7, part of the coarse coal powders are sorted out, and the remaining air-powder mixture are sorted by means of the rotation of the movable vane rotor 10 composed of a vane, some coarse coal powder are thrown to the outer conical housing and fall down along the outer conical housing, the qualified coal powders enter the four outlet pipe 12 and are fixed at the outlet main pipe 14 and then enter a fine powder separator, since the rotation speed of the variable frequency motor is adjustable, the adjustable range of the fineness of the coal powders is expanded, improving the coal powder uniformity index, a minute quantity of qualified coal powders fall to the top cone 8 and slide down along the top cone 8, when the mixture of the coarse coal powders and the qualified coal powders falls to the axial flow airfoil-type vane 3, since the axial flow airfoil-type vane 3 rotates, the kinetic energy of part of the sorted qualified coal powders is increased, such that the probability of part of the qualified coal powders performing secondary sorting is greatly increased, thereby improving the sorting efficiency of the sorting device; and the return powders fallen back to the oblique return powder outlet pipe 15 performing graded milling through milling gear disks, such that part of the unqualified return powders are milled into qualified coal powders, the return powder milling device therefore reduces the rate of the qualified coal powders to the return powders, reducing the resistance, improving the sorting efficiency, in turn improving the output of the pulverizing system and reducing unit consumption of pulverization.

The invention claimed is:

1. A high-efficiency, tandem biaxial dynamic sorting and return powder milling device with automatic baffle regulation, comprising a sorting device inlet pipe (1), an inner conical body (5), and an outer conical housing (27) provided with a return powder outlet pipe (15) at the bottom, a plurality of first-stage baffles (6) being horizontally provided along an inner circumference of said outer conical housing (27) at the middle height of the inner conical body, a circle of second-stage baffles (7) being horizontally provided along the interior of the outer conical housing (27) above said first-stage baffles (6), said first-stage baffles (6) and second-stage baffles (7) being both fixed at a single end to a baffle shaft (19), and an regulating rod (21) being provided on an outer portion of the baffle shaft passing out of the outer conical housing; an upper portion of the outer conical housing being provided with a plurality of explosion-proof doors (13), a variable frequency motor (11) being provided outside a top plate (38) of the outer conical housing, and said top plate (38) having an opening and being connected to an outlet main pipe (14), characterized in that:

an inner bearing bush fixing pipe (28) is fixedly mounted outside said sorting device inlet pipe (1), a circle of milling gears (34) for milling return powders is mounted in an annular cavity between the outer conical housing (27) and the inner bearing bush fixing pipe (28), said milling gears (34) are of a conical structure tapering from outside to inside, gear shafts (35) at the inner end and outer end of the milling gears are respectively fitted onto the inner bearing bush fixing pipe (28) and the outer conical housing (27) via milling device bearings (30), every two adjacent milling gears (34) are meshed with each other, and the gear shaft (35) of one of the milling gears (34) extends out of the outer conical housing (27) and is driven by a milling variable frequency motor (31).

2. The high-efficiency, tandem biaxial dynamic sorting and return powder milling device with automatic baffle regulation according to claim 1, characterized in that the milling device bearings (30) at the two ends of said milling gears (34) are both provided with a sealing device for preventing leaked coal powders from entering the bearings.

3. The high-efficiency, tandem biaxial dynamic sorting and return powder milling device with automatic baffle regulation according to claim 1, characterized in that an axial flow airfoil-type vane (3) is fitted on an outer side of an impact cone (4) of said inner conical body (5).

4. The high-efficiency, tandem biaxial dynamic sorting and return powder milling device with automatic baffle regulation according to claim 1, characterized in that a movable vane rotor (10) composed of a movable vane is fixedly mounted on an outer side of the top cone (8) of said inner conical body (5), so as to centrifugally sort the coal powders.

5. The high-efficiency, tandem biaxial dynamic sorting and return powder milling device with automatic baffle regulation according to claim 1, characterized in that the degrees of opening of said first-stage baffles (6) and second-stage baffles (7) are respectively controlled and regulated by a respective automatic baffle regulating mechanism which comprises a motor with a brake (23) and guiding pulleys (26), each baffle shaft (19) is fixed to a dial (37) perpendicular thereto at the exterior of the outer conical housing, and a steel wire rope fixing device (22) is provided between an outer edge of said dial and the regulating rod (21) fixed to the same baffle shaft (19), and the shaft sleeve is welded to the outer conical housing and is reinforced via a rib (16); said baffle shaft (19) is fixed inside a shaft sleeve (18) of the bearing (17); and an output shaft of said motor with a brake (23) is fixed to a steel wire rope (24), said steel wire rope (24) is successively wound around the guiding pulley (26) at one side of the dial (37), to the steel wire rope fixing device (22) along the outer edge of the dial (37), continuing to the guiding pulleys (26) between adjacent dials (37) along the outer edges of the dials (37), is connected in series with the circle of the first-stage baffles (6) or the second-stage baffles (7), respectively, and finally returns to the output shaft of the motor with a brake (23) fixed to the steel wire rope (24), forming a closed steel wire rope regulating ring.

6. The high-efficiency, tandem biaxial dynamic sorting and return powder milling device with automatic baffle regulation according to claim 5, characterized in that the motor with a brake (23) of said first-stage baffles (6) or second-stage baffles (7) is mounted above the first-stage baffles (6) or the second-stage baffles (7), the steel wire rope (24) driven by said motor with a brake (23) is horizontally oriented at two sides of said motor output shaft, changed to be oriented vertically after passing the pulley, and is wound around the guiding pulleys (26) on side faces of two adjacent dials (37), and connected to each dial (37) and regulating rod (21) in sequence.

7. The high-efficiency, tandem biaxial dynamic sorting and return powder milling device with automatic baffle regulation according to claim 6, characterized in that a balancing weight (25) for regulating the degree of balance of the automatic regulating mechanism is fixed to each of the steel wire ropes in vertical orientation of said steel wire rope (24) at the two sides of the motor with a brake (23).

8. The high-efficiency, tandem biaxial dynamic sorting and return powder milling device with automatic baffle regulation according to claim 1, characterized in that a plurality of openings connected to the outlet pipe (12) are evenly distributed in said top plate (38), and the other end of said outlet pipe (12) is connected to an input end of the outlet main pipe (14).

9. The high-efficiency, tandem biaxial dynamic sorting and return powder milling device with automatic baffle regulation according to claim 8, characterized in that four outlet pipes (12) are provided above said top plate (38), and the four outlet pipes (12) spirally rotate and are connected to the outlet main pipe (14).

10. The high-efficiency, tandem biaxial dynamic sorting and return powder milling device with automatic baffle regulation according to claim 1, characterized in that a movable vane rotor (10) for centrifugal sorting is fixedly mounted on an outer side of an upper portion of said inner conical body (5); and a clearance is remained between said inner conical body (5) and both said first-stage baffles (6) and second-stage baffles (7), and the inner conical body (5) is a cavity driven to rotate by an output shaft (9) of the variable frequency motor (11).

* * * * *